US006286442B1

(12) United States Patent
Ranki

(10) Patent No.: US 6,286,442 B1
(45) Date of Patent: Sep. 11, 2001

(54) SUPPORT DEVICE FOR FURNACE

(75) Inventor: Markus Ranki, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/652,362

(22) Filed: Aug. 31, 2000

(30) Foreign Application Priority Data

Sep. 13, 1999 (FI) ..... 991942

(51) Int. Cl.[7] ..... F23M 5/04
(52) U.S. Cl. ..... 110/336; 266/285; 432/251
(58) Field of Search ..... 110/336; 266/285, 266/197, 280, 286; 432/126, 251

(56) References Cited

U.S. PATENT DOCUMENTS 1,710,257 * 4/1929 Haniman ..... 110/336
2,420,126 * 5/1947 Curll et al. ..... 432/134
3,190,818 * 6/1965 Otto ..... 202/268
3,295,280 * 1/1967 Kettner ..... 52/378
4,240,234 * 12/1980 Eisenger et al. ..... 52/261
4,369,032 * 1/1983 Lowrance et al. ..... 432/247
4,773,630 * 9/1988 Carminati et al. ..... 266/285

* cited by examiner

*Primary Examiner*—Henry Bennett
*Assistant Examiner*—K. B. Rinehart
(74) *Attorney, Agent, or Firm*—Morgan & Finnegan LLP

(57) ABSTRACT

A support device for a furnace, particularly the bottom furnace of a flash smelting furnace, includes a fastening device flexibly connecting a pillar element to a support structure. The pillar element includes a support part having a slot for receiving a counterpart attached to the support structure. The engagement of the counterpart with the slot controls the horizontal motion of the pillar element as the furnace walls move caused by thermal expansion.

10 Claims, 3 Drawing Sheets

SUPPORT DEVICE FOR FURNACE

The present invention relates to a support device for a furnace, particularly the bottom furnace of a flash smelting furnace.

DESCRIPTION OF THE PRIOR ART

Typically furnaces used in the production of metals, for example flash smelting furnaces, comprise a furnace space with walls typically lined with fire-resistant material. Around the furnace walls, there is typically arranged a supporting construction comprising, among others, vertical support pillars that are spaced apart and provide support for the furnace walls, among others. The pillars are arranged to be flexibly attached to other support structures, so that they allow the movement of the furnace walls that is caused by thermal expansion. The furnace is arranged on top of a foundation that also supports the rows of vertical support pillars. A flash smelting furnace has a bottom part preferably provided with a curved top surface, which is curved, starting from the centre part, upwardly towards the side walls. The side walls are typically structural elements arranged at the bottom part edges by means of a joint that allows the shifting of the walls caused by thermal expansion. Underneath the furnace wall support pillars, there are provided so-called base plates bedded in a concrete foundation. At the bottom part, the side wall support pillars have extended as far as the base plates. The support pillars are attached to the support structures by means of flexible elements. When the furnace temperature is high, the side wall support pillars have shifted, along with the side walls, when the flexible elements have allowed, both up and away from the furnace, so that an aperture has formed between the support pillar and the base plate. The support structures according to the prior art require a foundation extending to underneath the vertical support pillars, which in addition to space also requires a lot of construction material. The aperture created between the pillars and the base plate collects dirt and is a drawback also from the esthetical point of view.

BRIEF SUMMARY OF THE INVENTION

The object of the invention is to realise a completely new support device arrangement, whereby the drawbacks of the prior art are avoided.

The arrangement according to the invention is characterised by what is set forth in the appended claims.

The arrangement according to the invention has several remarkable advantages. Now the furnace foundation does not have to extend underneath the vertical support pillars, in which case both concrete and steel needed in the base plates is saved. Cleaning is easier, because underneath the furnace pillars there are not left small apertures that are difficult to keep clean. When the arrangement according to the invention is applied to the renewing of old furnaces, a new and a larger furnace can be built on top of the old foundation. The direction of the wall pillar, caused by the movement of the furnace walls, is easier to control than before. By making the support surface in the form of a slot, there is obtained a simple and secure solution for controlling the motion of the support pillar. When a pin element is used as a counterpart, there is realised an easily attachable and simple arrangement that is particularly well suited to be used together with the slot serving as the support surface. Said counterpart can also advantageously be used as a fastening point for the pull bar of the fastening device.

The invention is explained in more detail below with reference to the appended drawings, where

DETAILED DESCRIPTION OF THE INVENTION

Figure 1:
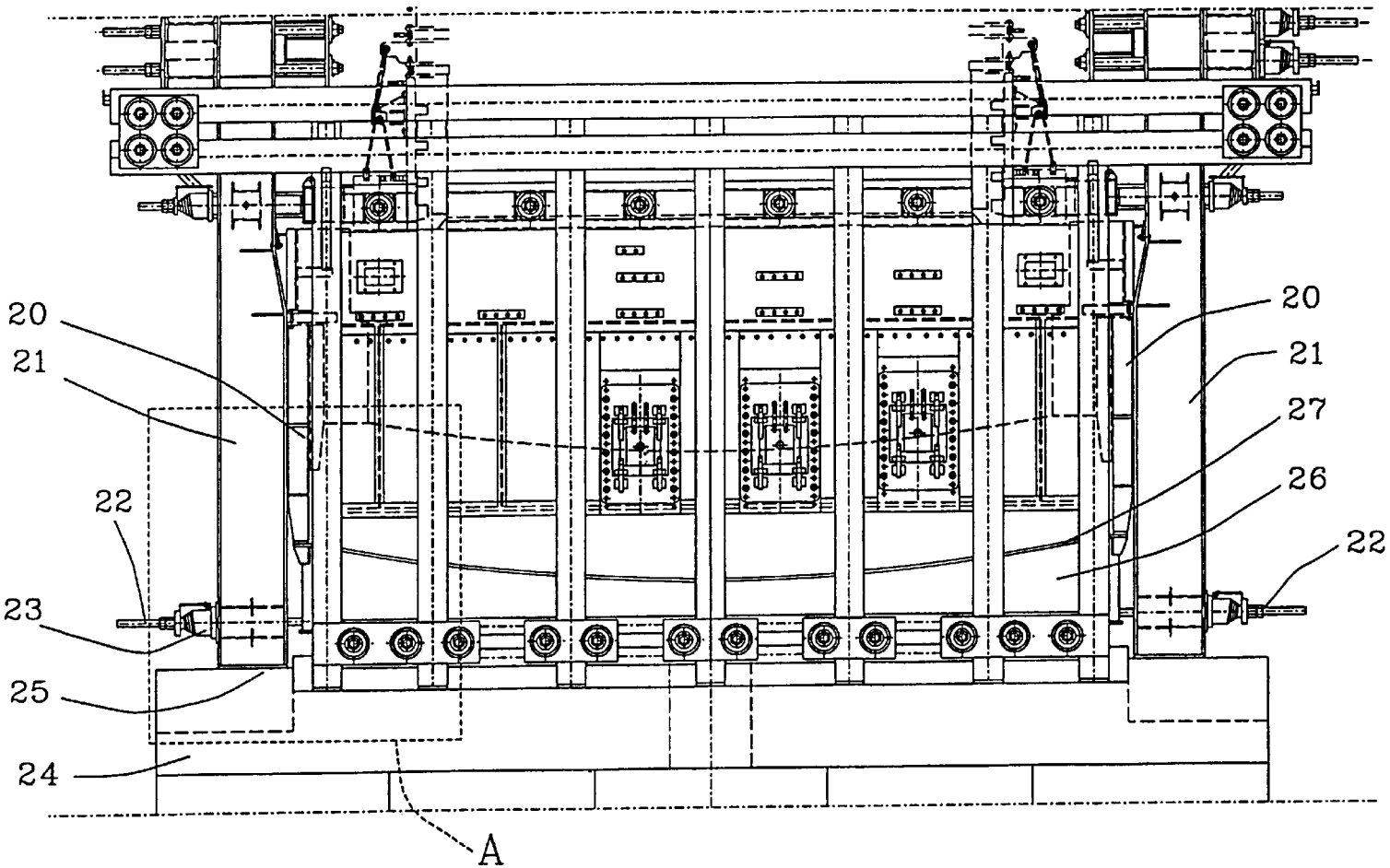
Fig. 1 PRIOR ART
FIG. 1 illustrates a prior art arrangement provided in connection with the bottom furnace of a flash smelting furnace.

FIG. 1 shows, in simplified illustration, part of a prior-art smelting furnace support structures seen at the furnace end. Around the furnace walls, there is typically provided a support structure that comprises, among others, vertical support pillars 21 that are spaced apart and support the furnace walls 20, among others. The pillars are fastened, by means of flexible elements 23 of fastening device 22, flexibly to the support structures, so that they allow for instance the motion of the furnace walls 21 caused by thermal expansion. The furnace is arranged on top of a foundation 24, which also supports the rows of vertical support pillars 21. Underneath the support pillars 21, there are used so-called base plates 25 that are bedded in the concrete foundation 24. The flash smelting furnace comprises a bottom part 26 preferably provided with a curved top surface 27 that is curved from the center part upwardly towards the side walls 20, so that there is formed a concave furnace bottom surface. Typically the side walls 20 are structural elements arranged at the edges of the bottom part 26 by means of a joint that allows the shifting of the walls caused by thermal expansion. The pillars are also fixed at their top part, for instance by means of pull bars and flexible elements. The fastening of the top part is not dealt with here, but it is assumed to represent technology known as such for a man skilled in the art.

Figure 2:
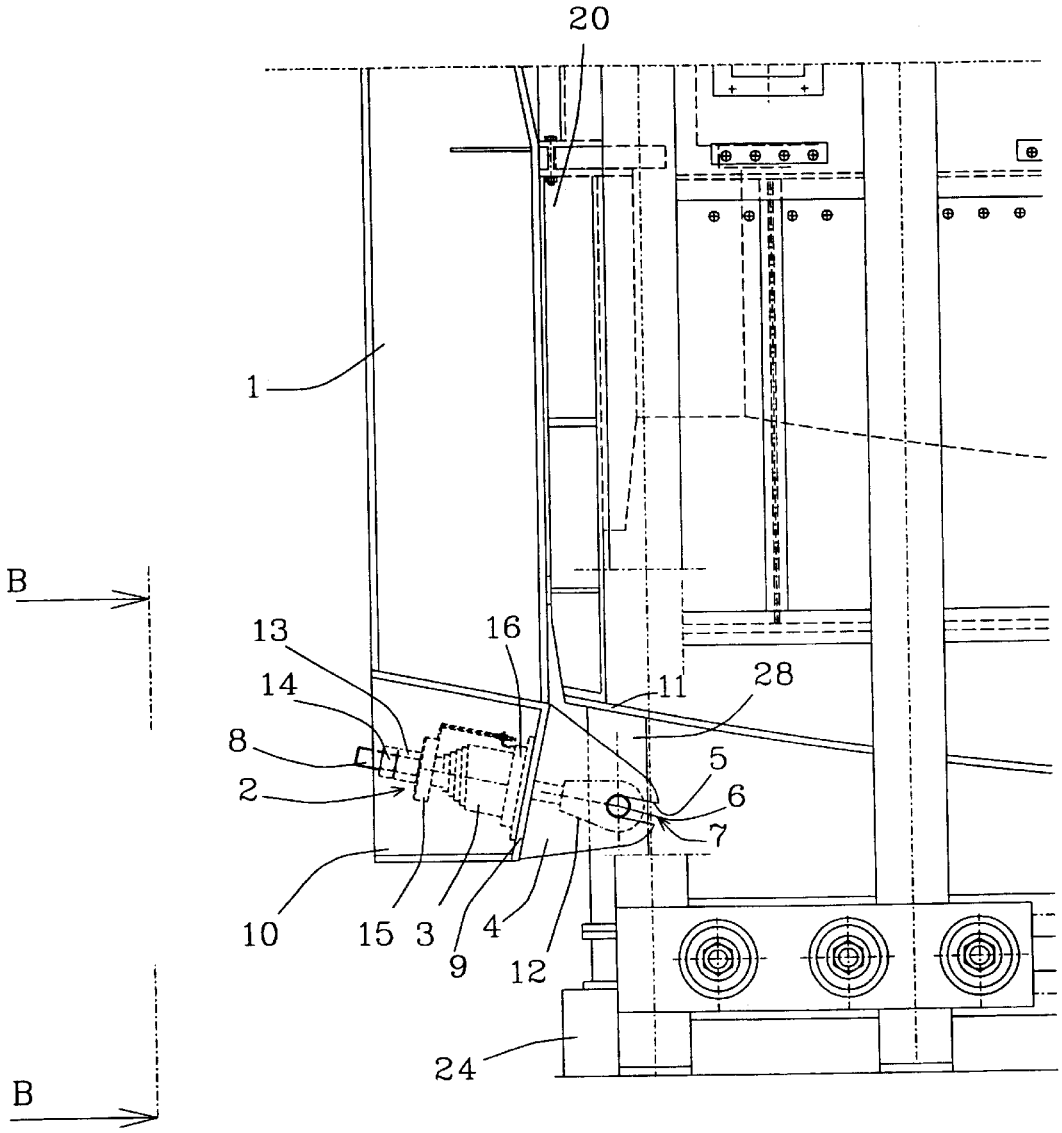
FIG. 2 illustrates a support device according to the invention, provided in connection with the bottom furnace of a flash smelting furnace, fitted at point A of FIG. 1.
Figure 3:
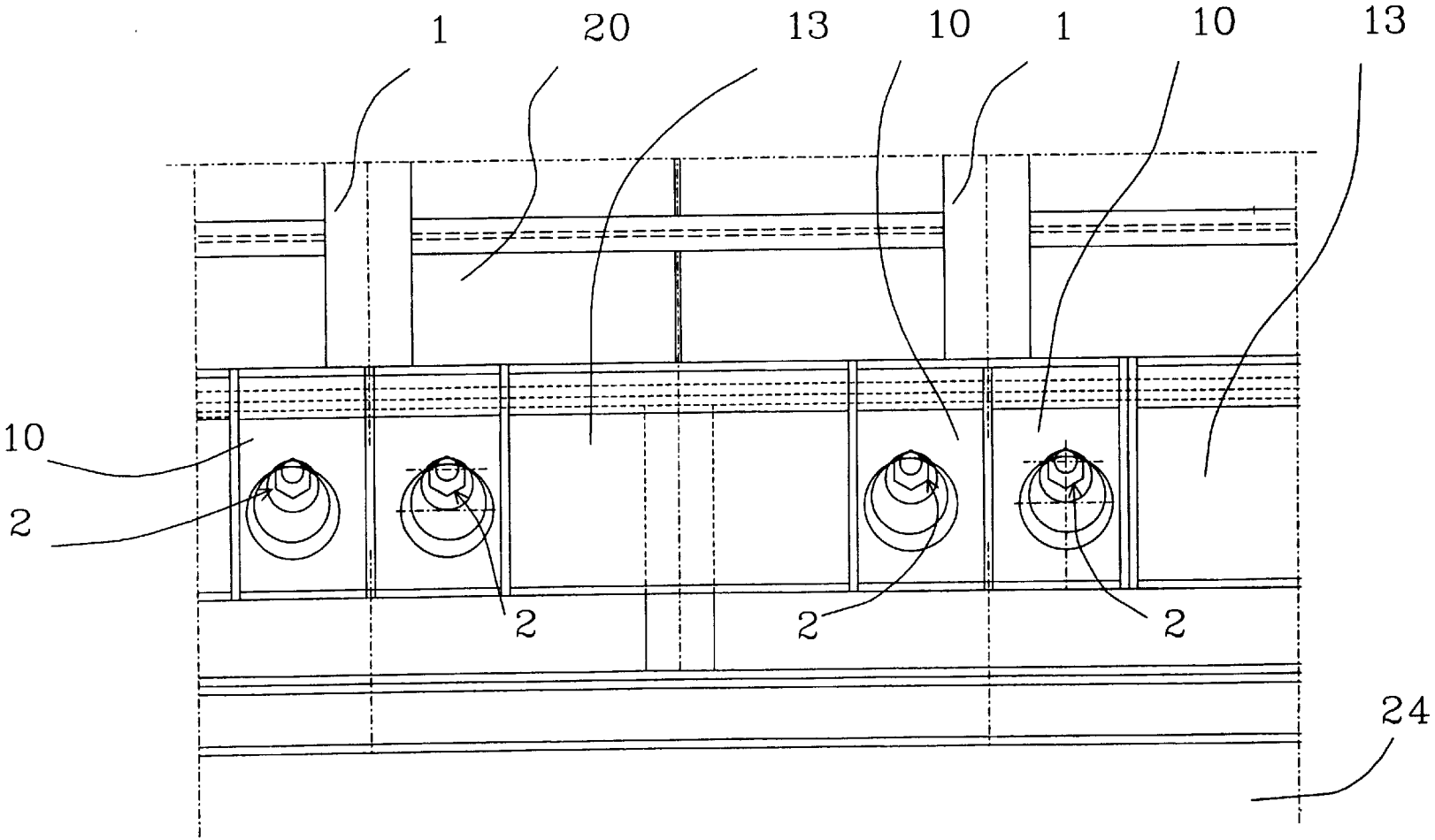
FIG. 3 illustrates a support device according to the invention, seen in the direction B—B of FIG. 2.

FIGS. 2 and 3 illustrate an arrangement according to the invention when applied in connection with the bottom furnace of a flash smelting furnace, within the area A marked with a dotted line in FIG. 1. In FIGS. 2 and 3, the reference numbers for various parts differ from those used in FIG. 1. The support device according to the invention comprises a pillar part 1 and a pillar part fastening device 2, provided with at least one flexible element 3. In the pillar part 1, there is arranged at least one support part 4 comprising a support surface 5 for at least one counterpart 6 provided in the furnace structures. The supporting part 4 extends from the level of the side surface on the furnace wall 20 to a distance towards the furnace. In the embodiment according to FIG. 2, the supporting part 4 is a lug that is typically attached, for example by means of welding, to the pillar part 1, preferably to its bottom part. In the embodiment according to the drawing, the support surface 5 is the side surface of the slot 7 formed in the supporting part 4. In connection with each pillar element 1, there can be several adjacent supporting parts 4. For instance the counterpart 6 is a pin element that is typically arranged in a transversal direction with respect to the pillar element 1, so that it fits into the slot of the supporting part 4. The contacting surfaces of the slot 7 and the counterpart 6 control the motion of the pillar element, at least partly. In the embodiment according to FIG. 2, the pin element is a bar that is round in cross-section and attached to the support structure 28 of the bottom part. The pin element is arranged somewhat towards the furnace from the level of the outer wall of the wall element, and underneath the junction surface 11 between the wall and the bottom.

At least in one cross-sectional direction, the support surface 5 of the supporting part 4 is essentially parallel to the junction surface 11 between the wall element and the bottom element 20. According to a preferred embodiment, the support surface 5 is parallel to a line tangent of the junction surface 11. Thus the motional direction of a pillar element can be affected by means of the shapes of the support surface 5 and the counterpart.

In the embodiment according to FIG. 2, the counterpart 6 provides a fastening point for the pull bar 8 of the fastening device 2. The pull bar 8 is attached, by a fastening loop 12, to the pin element. In the pillar element, there is arranged a second support surface 9, against which the flexible element 3 of the fastening device 2 is tightened and locked by tightening means 13, 14. In the support surface 9, there is provided an aperture for the pull bar 8 of the fastening device 2. In the case of FIG. 2, the pull bar 8 is provided at both ends with flange elements 15, 16.

In the pillar element 1, preferably at the bottom part thereof, there is arranged at least one compartment 10 in order to protect the fastening device 2. The adjacent support pillars 1 are interconnected by at least one transversal support pillar 13. In the embodiment according to FIG. 3, each support pillar 1 is at the bottom part attached to the furnace structures by two fastening devices 2. Thus the compartments 10 are arranged symmetrically with respect to the pillar 1. The transversal support beam 13 is preferably arranged at the compartments 10, in between the compartments 10 of adjacent pillars. The compartments 10 protect the fastening device 1, particularly its flexible element 3, against possible melt leaks, among others.

In the installation step, the pillar elements 1 are supported, at their inclined slots 7, against the pins serving as counterparts 6, which pins also function as fastening points for the pull bars 8 of the fastening device 2. Later during operation, the pillar elements 1 move along their inclined slots 7, and the support of the pillars is at least partly shifted to depend on the friction between the pillar elements 1 and the wall elements 20.

The support device according to the invention can also be used in connection with the end walls of a flash smelting furnace. In that case the motional direction of the walls is mainly horizontal, which means that the support surface of the support element can also be horizontal.

It is obvious for a man skilled in the art that the invention is not restricted to the above described embodiments only, but it can be modified within the scope of the appended claims.

What is claimed is:

1. A support device for supporting a bottom portion of a furnace which includes furnace walls, said support device comprising:

a pillar element including a support part, said support part having a slot defining a support surface;

a support structure for the bottom portion of the furnace, said support structure supporting a counterpart said counterpart being a pin element; and a fastening device flexibly connecting the pillar element to the support structure to permit movement of the furnace walls caused by thermal expansion, wherein the support surface of the slot defined by the support part receives the counterpart and controls the horizontal motion of the pillar element.

2. A support device according to claim 1, wherein the support surface is a side surface of the slot made in the support part.

3. A support device according to claim 1, wherein the fastening device comprises a pull bar passing through an aperture defined in the pillar element, a fastening loop attached to an end of the pull bar, and at least one flexible element coupling the pull bar to the pillar element to resist displacement of the pillar element radially inwardly towards the furnace wall, wherein the counterpart provides a fastening point for the fastening loop to the support structure.

4. A support device according to claim 3, wherein in the pillar element, there is arranged a second support surface, against which the flexible element of the fastening device is secured.

5. A support device according to claim 1, wherein the pillar element is provided with a compartment in order to protect the fastening device.

6. A support device according to claim 1, wherein the bottom portion of the furnace has a junction surface, wherein the support surface of the slot defined by the support part is at least in one transversal direction essentially parallel to the junction surface.

7. A support device according to claim 1, wherein the bottom portion of the furnace has a junction surface, wherein the support surface is parallel to a tangent of the junction surface.

8. A support device according to claim 1, wherein adjacent support pillars are interconnected by at least one transversal support beam.

9. A support device according to claim 1, wherein the pillar element includes a bottom end, wherein the bottom end of the pillar element is attached to the support structure by two fastening devices.

10. A support device of claim 1, wherein the furnace is a flash smelting furnace.

* * * * *